United States Patent [19]

Palmer

[11] Patent Number: 5,023,952

[45] Date of Patent: Jun. 18, 1991

[54] CLOTHING ITEM

[76] Inventor: Marcia R. Palmer, 2309 Coachlight, Edmond, Okla. 73013

[21] Appl. No.: 334,673

[22] Filed: Apr. 6, 1989

[51] Int. Cl.[5] ..... A41B 13/06; A41D 11/06

[52] U.S. Cl. ..... 2/69; 2/75; 2/80; 2/83

[58] Field of Search ..... 2/2, 46, 69, 69.5, 75, 2/80, 84, 83, 78 R, 79, 111, 115, 227

[56] References Cited

U.S. PATENT DOCUMENTS

| | | | |
|---|---|---|---|
| 842,224 | 1/1907 | Mills . | |
| 1,192,288 | 7/1916 | Emery | 2/79 |
| 1,260,873 | 3/1918 | Colman | 2/111 |
| 1,365,526 | 1/1921 | Milkes | 2/111 |
| 1,393,900 | 10/1921 | Milkes | 2/83 |
| 1,973,421 | 9/1934 | Wallace | 2/80 |
| 2,028,602 | 1/1936 | Hanson | 2/80 X |
| 2,227,751 | 1/1941 | Idelman | 2/69.5 |
| 2,291,861 | 8/1942 | Astrove | 2/80 |
| 2,412,502 | 12/1946 | Garrison | 2/80 X |
| 2,505,239 | 4/1950 | Goldstein | 2/80 |
| 2,546,057 | 3/1951 | Bodin et al. | 2/75 X |
| 2,570,428 | 10/1951 | Clifford | 2/80 X |
| 2,578,323 | 12/1951 | Sillaway . | |
| 2,580,969 | 1/1952 | Stephenson | 2/80 |
| 2,588,542 | 3/1952 | Kunz | 2/80 |
| 2,671,220 | 3/1954 | Geissmann | 2/80 |
| 2,705,326 | 4/1955 | Lahnstein et al. | 2/83 |
| 2,876,455 | 3/1959 | Harmon | 2/80 |
| 3,034,132 | 5/1962 | Landsberger . | |
| 3,081,772 | 3/1963 | Brooks et al. . | |
| 3,412,407 | 11/1968 | Key . | |
| 3,477,065 | 11/1969 | Hoover . | |
| 3,568,213 | 3/1971 | Mason | 2/80 |
| 4,257,127 | 3/1981 | Kaupin et al. | 2/75 |
| 4,266,299 | 5/1981 | Beal . | |
| 4,422,186 | 12/1983 | Loney . | |
| 4,649,574 | 3/1987 | Michels . | |
| 4,675,918 | 6/1987 | O'Brien . | |
| 4,745,634 | 5/1988 | Douez | 2/69 |
| 4,769,855 | 9/1988 | Tsai . | |
| 4,897,885 | 2/1990 | Lunt | 2/69.5 |
| 4,901,371 | 2/1990 | Christians | 2/69.5 |

OTHER PUBLICATIONS

Exhibit A, Sears Winter/Fall Catalog, pp. 309 and 310, Items A and D.

Exhibit B, Sears Winter/Fall Catalog, p. 324, Items A and B.

*Primary Examiner*—Werner H. Schroeder

*Assistant Examiner*—Jeanette E. Chapman

*Attorney, Agent, or Firm*—Dunlap, Codding, Peterson & Lee

[57] ABSTRACT

An item of clothing adapted to be worn by an individual comprising a body panel and a lower end panel. The lower end panel is connected to the body panel so that the torso of the individual is disposed generally on the body panel and the lower end panel then is folded over a lower portion of the individual's torso and a right side portion of the body panel is folded over a portion of the individual's torso and attached to a portion of the body panel and a left side portion of the body panel is folded over a portion of the individual's torso and attached to the lower end panel for securing the body panel and the lower end panel assembled generally on the individual's torso. The clothing item also includes a left leg panel adapted for receiving the individual's left leg and a right leg panel adapted for receiving the individual's right leg.

10 Claims, 4 Drawing Sheets

CLOTHING ITEM

FIELD OF THE INVENTION

The present invention relates to a clothing item having a body panel and a lower end panel which is connected to the body panel wherein the lower end panel is folded over a portion of the individual's torso and a left side portion of the body panel is folded over a portion of the individual's torso and attached to the lower end panel and a right side portion of the body panel is folded over a portion of the individual's torso and attached to the lower end panel.

DESCRIPTION OF THE PREFERRED EMBODIMENTS

BRIEF DESCRIPTION OF THE PREFERRED EMBODIMENTS

Figure 1:
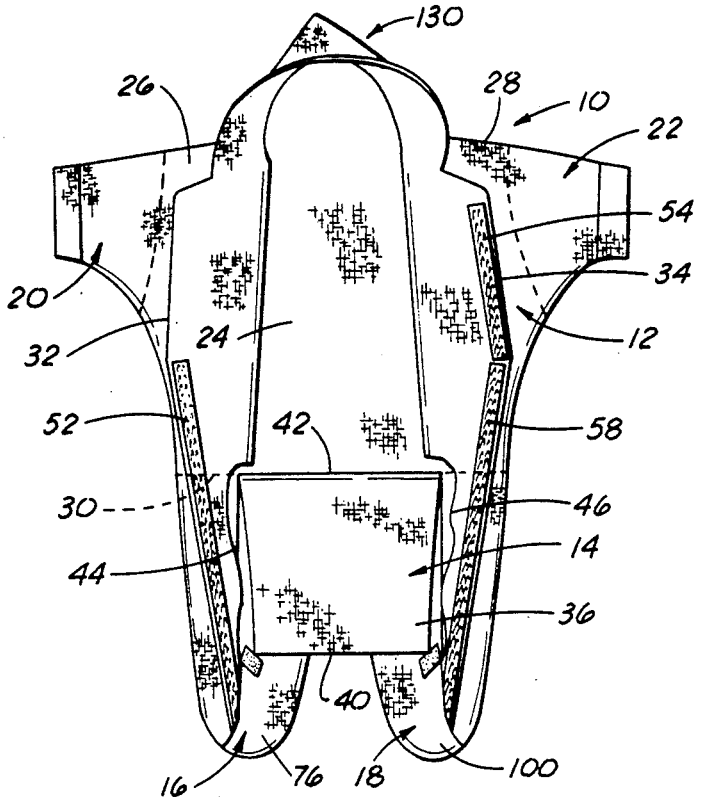
FIG. 1 is a plan view of a clothing item constructed in accordance with the present invention showing the body panel in an opened position and showing the lower end panel in the opened or unfolded position.

Referring to the drawings in general and to FIG. 1 in particular, shown therein and designated therein by the reference numeral 10 is a clothing item constructed in accordance with the present invention. The clothing item 10 basically comprises a body panel 12, a lower end panel 14, a right leg panel 16, a left leg panel 18, a right sleeve 20 and a left sleeve 22. The various portions 12, 14, 16, 18, 20 and 22 of the clothing item 10 are integrally connected in one form and these have been shown in FIGS. 1, 2, 3 and 4 separated by dashed lines for the purposes of separately identifying the various portions or components of the clothing item 10.

As shown in FIGS. 1 through 4, the body panel 12 includes an inner surface 24, an outer surface 26, an upper end 28, a lower end 30, a right side 32 and a left side 34. In general, an individual's torso is disposed generally on a portion of the inner surface 24 of the body panel 12 and a portion of the body panel 12 generally near the right side 32 thereof is wrapped over a portion of the individual's torso and another portion of the body panel 12 generally near the left side 34 thereof is wrapped about a portion of the individual's torso so that the body panel 12 is wrapped generally about a substantial portion of the individual's torso.

The lower end panel 14 includes an inner surface 36 (FIG. 1), an outer surface 38 (FIG. 2), an upper end 40, a lower end 42, a right side 44 (FIG. 1) and a left side 46 (FIG. 1). A portion of the lower end panel 14 is connected to the left leg panel 18 and the right leg panel 16 thereby connecting the lower end panel 14 to the body panel 12 by way of the right and left leg panels 16 and 18 generally midway between the right and the left side 44 and 46 thereof and generally at the lower end 42 thereof is attached to the lower end 30 of the body panel A portion of the right leg panel 16 generally at the left side 70 thereof and extending a distance therefrom is connected to a portion of the lower end 42 of the lower end panel 14 and a portion of the left panel 18 generally near the right side 96 thereof and extending a distance therefrom is connected to a portion of the lower end 42 of the lower end panel 14 thereby connecting the lower end panel 14 to the body panel 12 by way of the right and the left leg panels 16 and 18. 12. The lower end panel 14 has an opened position (shown in FIG. 1) wherein the lower end panel 14 extends a distance outwardly from the body panel 12 terminating with the upper end 40 of the lower end panel 14. The lower end panel 14 also has a closed or folded position (shown in FIGS. 2, 3 and 4) wherein the lower end panel 14 is folded generally about the connection between the lower end panel 14 and the body panel 12 to a position wherein the inner surface 36 of the lower end panel 14 is disposed generally adjacent a portion of the inner surface 24 of the body panel 12. More particularly, when an individual's torso is disposed generally on a portion of the inner surface 24 of the body panel 12, the lower end panel 14 is folded to a position wherein the inner surface 36 of the lower end panel 14 is disposed generally adjacent a lower end portion of the individual's torso in the closed or folded position of the lower end panel 14.

Figure 2:
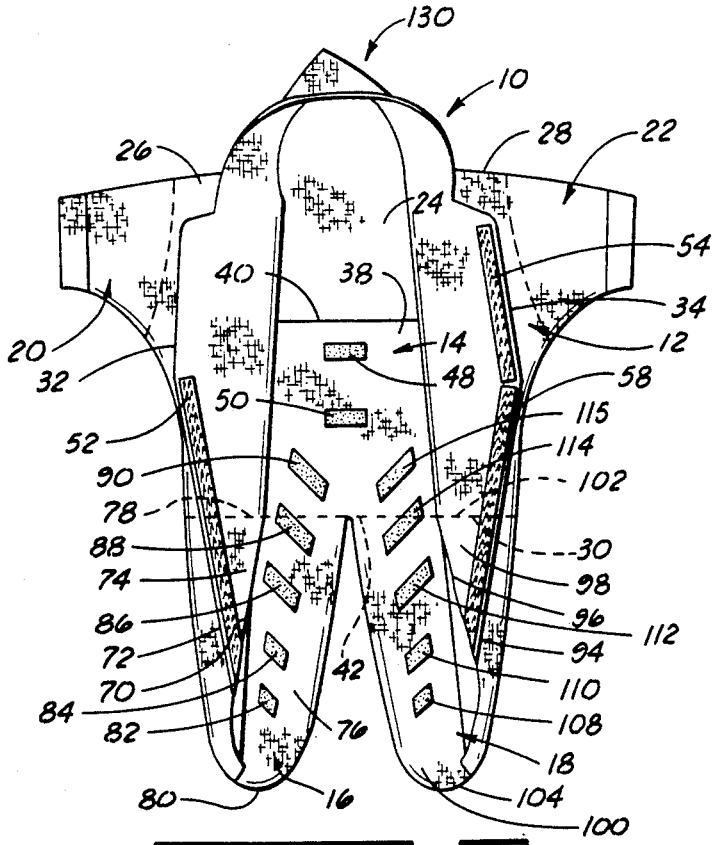
FIG. 2 is a plan view of the clothing item similar to FIG. 1, but showing the lower end panel in the folded or closed position.
Figure 3:
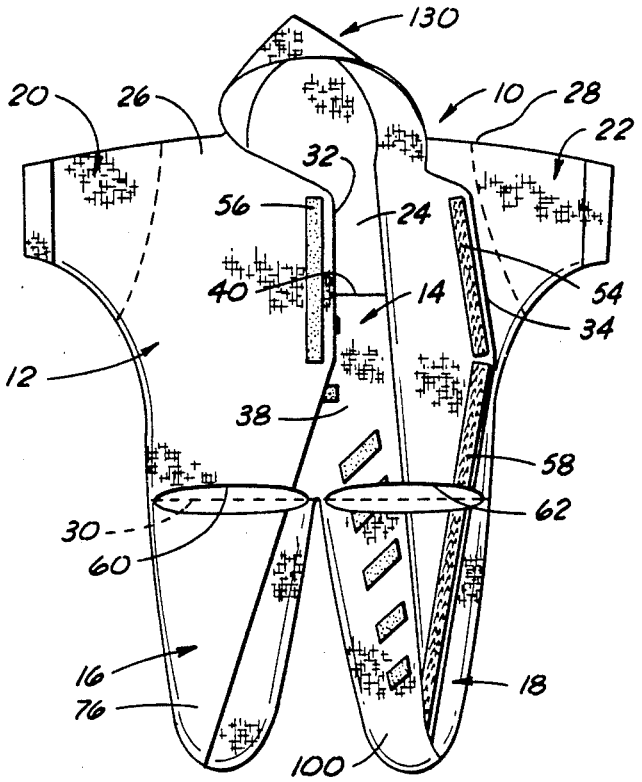
FIG. 3 is a view of the clothing item of the present invention, similar to FIG. 2, but also showing the right hand portion of the body panel in the closed position and connected to a portion of the lower end panel.

A plurality of spaced apart Velcro strips are disposed generally on the outer surface 38 of the lower end panel 14, two Velcro strips being shown in FIGS. 2 and 3 and designated therein by the general reference numeral 48 and 50.

A Velcro strip 52 is disposed generally on the inner surface 24 of the body panel 12, as shown in FIGS. 1 and 2. The Velcro strip 52 extends a distance generally along the right side 32 of the body panel 12.

A Velcro strip 54 is disposed generally on the inner surface 24 of the body panel 12, as shown in FIGS. 1, 2 and 3. The Velcro strip 54 extends a distance generally along the left side 34 of the body panel 12.

A Velcro strip 56 (FIG. 3) is connected to the outer surface 26 of the body panel 12 and the Velcro strip 56 extends a distance generally along the right side 32 of the body panel 12.

Another Velcro strip 58 (FIG. 1) is connected to a portion of the inner surface 24 of the body panel 12 and the Velcro strip 58 extends a distance generally along the left side 34 of the body panel 12.

The Velcro strips 48, 50, 52, 54, 56 and 58 each are positioned on the body panel 12 and the lower end panel 14 so that, in the closed or folded position of the lower end panel 14, a portion of the body panel 12 generally near the right side 32 thereof can be folded generally over a portion of the lower end panel 14 to a position wherein a portion of the inner surface 24 of the body panel 12 generally near the right side 32 thereof is disposed generally over and adjacent a portion of the outer surface 38 of the lower end panel 14 and, in this position, a portion of the Velcro strip 52 on the body panel 12 is connectingly engaged with a portion of the Velcro strips 48 and 50 on the lower end panel 14 to connect a portion of the body panel 12 generally near the right side 32 thereof to a portion of the outer surface 38 of the lower end panel 14.

Further, the Velcro strips 48, 50, 52, 54, 56 and 58 each are sized and positioned on the body panel 12 and the lower end panel 14 so that a portion of the body panel 12 generally near the left side 34 thereof can be folded generally over a portion of the lower end panel 14 to a position wherein a portion of the inner surface 24 of the body panel 12 generally near the left side 34 thereof is disposed generally over and adjacent a portion of the outer surface 38 of the lower body panel 14 and, in this position, a portion of the Velcro strip 58 is connectingly engaged with portions of at least one of the Velcro strips 48 and 50 to connect a portion of the body panel 12 generally near the left side 34 thereof to a portion of the lower end panel 14. Further, in this folded position of the portions of the body panel 12 generally near the right and left sides 32 and 34 thereof, a portion of the inner surface 24 of the body panel 12 generally near the left side 34 thereof is disposed generally over an adjacent portion of the outer surface 26 of the body panel 12 generally near the right side 32 thereof in a position wherein the Velcro strips 54 and 56 are disposed in a connecting position and the Velcro strips 54 and 56 are connectingly engaged to connect a portion of the body panel 12 generally near the right side 32 thereof in a position wherein the Velcro strips 54 and 56 are disposed in a connecting position and the Velcro strips 54 and 56 are connectingly engaged to connect a portion of the body panel 12 generally near the right side 32 thereof to a portion of the body panel 12 generally near the left side 34 thereof.

In this connected position of the body panel 12 and the lower end panel 14, the body panel 12 and the lower end panel 14 cooperate to substantially encompass the torso of an individual with a right leg opening 60 (FIG. 3) being formed generally between the connection of the lower end panel 14 to a portion of the body panel 12 and a portion of the body panel 12 generally near the right side 32 thereof and extending a distance from the right side 32 thereof. Further, in this position, a left leg opening 62 (FIG. 3) is formed generally between the connection between the lower end panel 14 and a portion of the body panel 12 generally near the left side 34 thereof and extending a distance from the left side 34 thereof.

The right leg opening 60 is adapted to receive the right leg of an individual which is extended through the right leg opening 60 in the operating position of the clothing item 10 with an individual's torso encompassed generally by the body panel 12 and the lower end panel 14.

The left leg opening 62 is adapted to receive the left leg of an individual which is extended through the left leg opening 62 in the operating position of the clothing item 10 with an individual's torso encompassed generally by the body panel 12 and the lower end panel 14.

The body panel 12 also includes a left arm opening 64, (FIG. 4) formed through a portion of the body panel 12 generally near the upper end 28 thereof which is shaped and adapted for receiving the individual's left arm which is extendible through the left arm opening 64.

The body panel 12 also includes a right arm opening 66 (FIG. 4) formed through a portion of the body panel 12 generally near the upper end 28 thereof which is shaped and adapted for receiving the individual's right arm which is extendible through the right arm opening 66.

The clothing item 10 also includes a neck opening 68 (FIG. 4) formed in the upper end 28 of the body panel 12 in the closed or connected position wherein the lower end panel 14 has been moved to the closed or folded position and the right side 32 and left side 34 portions of the body panel 12 have been folded over and connected to each other and to portions of the lower end panel 14, as described before. The neck opening 68 is shaped and adapted so that an individual's neck extends through the neck opening 68 when the body panel 12 and the lower end panel 14 are encompassing the individual's torso.

The right leg panel 16 includes a left side 70 (FIG. 2), a right side 72 (FIG. 2), an inner surface 74 (FIG. 2), an outer surface 76, an upper end 78 (FIG. 2) and a lower end 80 (FIG. 2). A portion of the right leg panel 16 generally at the right side 72 thereof and extending a distance therefrom is connected to a portion of the lower end 30 of the body panel 12 generally at the right side 32 of the panel 12 and extending a distance therefrom. Another portion of the right leg panel 16 generally at the left side 70 thereof and extending a distance therefrom is connected to a portion of the lower end 42 of the lower end panel 14. In one preferred form, the right leg panel 16 is formed as a continuous extension of the lower end panel 14 and the body panel 12. As shown in FIG. 1, the Velcro strip 52 extends generally along the right side 32 of the body panel 12 and the Velcro strip 52 also is connected to a portion of the inner surface 74 of the right leg panel 16 and extends a distance generally along the right side 72 of the right leg panel 16.

A plurality of Velcro strips are connected to the outer surface 76 of the right leg panel 16 generally near the left side 70 thereof, five Velcro strips being shown in FIG. 2 and designated therein by the reference numerals 82, 84, 86, 88 and 90. Each of the Velcro strips 82, 84, 86, 88 and 90 extends a distance generally between the left side 70 and the right side 72 of the right leg panel 16 for reasons which will be made more apparent below (as shown in FIG. 2, the Velcro strip 90, more particularly is connected to the lower end panel 14).

The left side 70 and the right side 72 portions of the right leg panel 16 are foldable to a position wherein a portion of the inner surface 74 generally near the right side 72 of the right leg panel 16 is disposed generally over a portion of the outer surface 76 generally near the left side 70 of the right leg panel 16 with a portion of the Velcro strip 52 being disposed generally over the Velcro strips 82, 84, 86, 88 and 90. A portion of the Velcro strip 52 also is connectingly engaged with the Velcro strip 50. In this position, the Velcro strip 52 is connected to the Velcro strips 82, 84, 86, 88 and 90 to connect the left side 70 to the right side 72 of the right leg panel 16. Since the Velcro strips 82, 84, 86, 88 and 90 are horizontally disposed (extend generally between the left side 70 and the right side 72), the Velcro strip 52 can be adjustably attached at various positions along the length of each of the Velcro strips 82, 84, 86, 88 and 90 for adjusting the space encompassed by the right leg panel 16, a right leg space 92 (FIG. 4) which is formed when the right side 72 is connected to the left side 70 of the right leg panel 16. The right leg space 92 is shaped and adapted to receive the right leg of an individual and, as the individual grows, the space encompassed by the right leg space 92 can be adjustingly varied by varying the position in which the Velcro strip 52 is connected to the Velcro strips 82, 84, 86, 88 and 90. In one preferred form as shown in FIG. 1, the Velcro strips 82, 84, 86, 88 and 90 each are disposed at an angle angling upwardly generally toward the lower end panel 14 for facilitating the adjustability of the right leg space 92, and to utilize more area of the Velcro strip.

The left leg panel 18 includes a left side 94 (FIG. 2), a right side 98 (FIG. 2), an inner surface 96 (FIG. 2), an outer surface 100, an upper end 102 (FIG. 2) and a lower end 104 (FIG. 2). A portion of the left leg panel 18 generally at the left side 94 thereof and extending a distance therefrom is connected to a portion to the lower end 30 of the body panel 12 generally at the left side 34 of the panel 12 and extending a distance therefrom. Another portion of the left leg panel 18 generally at the right side 96 thereof and extending a distance therefrom is connected to a portion of the lower end 42 of the lower end panel 14. In one preferred form, the left leg panel 18 is formed as a continuous extension of the lower end panel 14 and the body panel 12. As shown in FIG. 1, the Velcro strip 58 extends generally along the left side 34 of the body panel 12 and the Velcro strip 58 also is connected to a portion of the inner surface 98 of the left leg panel 18 and extends generally a distance along the left side 94 of the left leg panel 18.

A plurality of Velcro strips are connected to the outer surface 100 of the left leg panel 18 generally near the right side 96 thereof, five Velcro strips being shown in FIG. 2 and designated therein by the reference numerals 108, 110, 112, 114 and 115. The Velcro strip 115 more particularly is connected to the lower end panel 14. Each of the Velcro strips 108, 110, 112, 114 and 115 extends a distance generally between the left side 94 and the right side 96 of the left leg panel 18 for reasons which will be made more apparent below. The right side 96 and the left side 94 portions of the left leg panel 18 are foldable to a position wherein a portion of the inner surface 98 generally near the left side 94 of the left leg panel 18 is disposed generally over a portion of the outer surface 100 generally near the right side 96 of the left leg panel 18 with a portion of the Velcro strip 58 being disposed generally over the Velcro strips 108, 110, 112, 114 and 115. In this position, the Velcro strip 58 is connected to the Velcro strips 108, 110, 112, 114 and 115 to connect the left side 94 to the right side 96 of the left leg panel 18. A portion of the Velcro strip 58 also is connectingly engage with a portion of the Velcro strip 50.

Since the Velcro strips 108, 110, 112, 114 and 115 are horizontally disposed (extend generally between the left side 94 and the right side 96), the Velcro strip 58 can be adjustably attached at various positions along each of the Velcro strips 108, 110, 112, 114 and 115 for adjusting the space encompassed by the left leg panel 18. A left leg space 116 (FIG. 4) which is formed when the right side 96 is connected to the left side 94 of the left leg panel 18. The left leg space 116 is shaped and adapted to receive the left leg of an individual and, as the individual grows, the space encompassed by the left leg space 116 can be adjustingly varied by varying the position in which the Velcro strip 58 is connected to the Velcro strips 108, 110, 112, 114 and 115. In one preferred form as shown in FIG. 2, the Velcro strips 108, 110, 112, 114 and 115 each are disposed at an angle angling upwardly generally toward the lower end panel 14 for facilitating the adjustability of the left leg space 116, and for utilizing more area of the Velcro.

Figure 4:
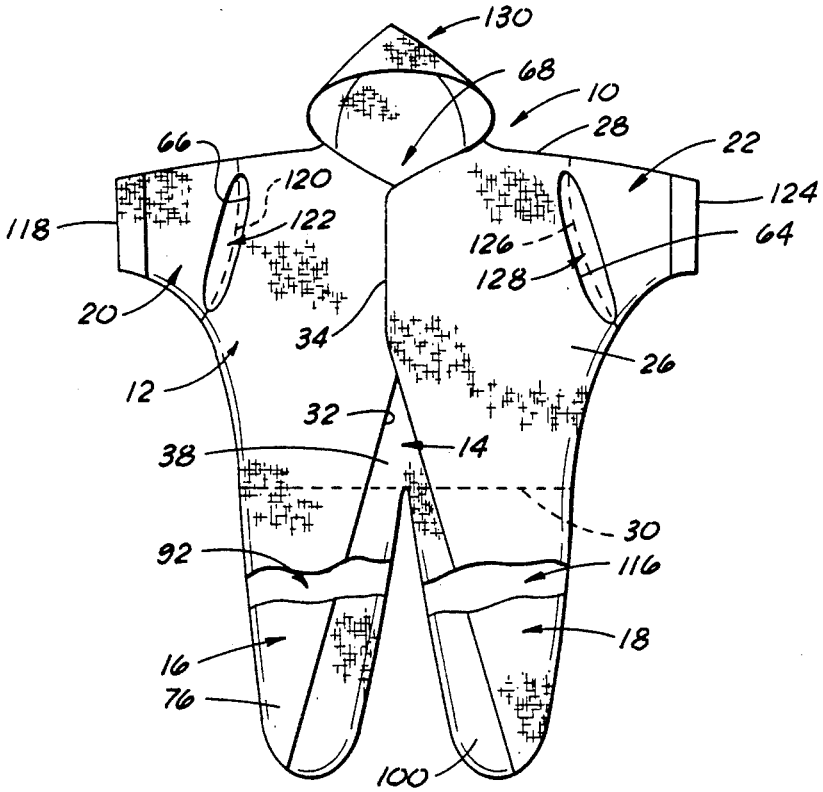
FIG. 4 is a view of the clothing item of the present invention similar to FIG. 3, but showing a left hand portion of the body panel folded to the closed position and attached to a portion of the lower end panel.

As shown in FIG. 4, the right sleeve 20 has a first end 118 and a second end 120. A right arm opening 122 is formed through the right sleeve 20 intersecting the first and the second ends 118 and 120. The second end 120 of the right sleeve 20 is connected to the body panel 12 and positioned so that the right arm opening 66 is generally aligned with the right arm opening 122 in the right sleeve 20. The right arm opening 122 is sized and adapted to accommodate the right arm of an individual which is insertable through the right arm opening 122.

The left sleeve 22 has a first end 124 and a second end 126. A left arm opening 128 is formed through the left sleeve 22 intersecting the first and the second ends 124 and 126. The second end 126 of the left sleeve 22 is connected to the body panel 12 and positioned so that the left arm opening 64 is generally aligned with the left arm opening 128 in the right sleeve 22. The left arm opening 128 is sized and adapted to accommodate the left arm of an individual which is insertable through the left arm opening 128.

The clothing item 10, more particularly, is adapted as a baby clothing item. In use, the clothing item 10 opened to the opened position shown in FIG. 1 wherein the lower end panel 14 is in the opened position extending a distance from the lower end 30 of the body panel 12. The baby's torso is placed on a portion of the inner surface 24 of the body panel 12 generally between the right and the left sides 32 and 34 of the body panel 12 with the baby's head and neck being disposed generally over the neck opening 68, the baby's right leg extending generally over the right leg opening 60 and the baby's left leg extending generally over the left leg opening 62. In this position, the lower end panel 14 is folded upwardly over a lower portion of the baby's torso to a position wherein the inner surface 36 of the lower end panel 14 as disposed generally about a lower portion or mid-section of the baby's torso depending on the size of the baby. In this position, the baby's left leg extends generally through the opened left leg panel 18 and the baby's right leg extends generally through the opened right leg panel 16.

In this position, a portion of the body panel 12 generally near the right side 32 thereof is folded generally over a portion of the baby's torso to a position wherein a portion of the body panel 12 generally near the right side 32 thereof is disposed generally over and adjacent a portion of the outer surface 38 of the lower end panel 14 and a portion of the right leg panel 16 generally near the right side 72 thereof is disposed generally over a portion of the outer surface 76 of the right leg panel 16. In this position, the right side 32 portion of the body panel 12 is removably and adjustably connected to the outer surface 38 of the lower end panel 14 and the right side 72 portion of the right leg panel 16 is removably and adjustably connected to the left side 70 portion of the right leg panel 16. In this position, the right half of the baby's torso generally is encompassed by a portion of the body panel 12 and the lower end panel 14 and the baby's right leg generally is encompassed by the right leg panel 16 and disposed generally within the right leg space 92.

A portion of the body panel 12 generally near the left side 34 thereof then is folded generally over a portion of the left side of the baby's torso to a position wherein a portion of the inner surface 24 of the body panel 12 generally near the left side 34 thereof is disposed generally over a portion of the outer surface 38 of the lower end panel 14 and a portion of the left leg panel 18 generally near the left side 94 thereof is disposed generally over a portion of the outer surface 100 of the right leg panel 18 generally near the left side 96 thereof. In this position, the left side 34 of the body panel 12 is connected to a portion of the outer surface 38 of the lower end panel 14 and the left side 94 of the left leg panel 18 is connected to the right side 96 of the left leg panel 18. In this position, the body panel 12 and the lower end panel 14 cooperate to substantially encompass the torso of the baby with the baby's right leg being disposed generally in the right leg space 92 and the baby's left leg being disposed generally in the left leg space 116. In this position, the baby's left arm is extended through the left arm opening 64 and through the left arm opening 128 in the left sleeve 22 and the baby's right arm is extended through the right arm opening 66 and through the right arm opening 122 in the right sleeve 20.

In the embodiment of the invention shown in FIGS. 1 through 4, the clothing item 30 also includes a hood which is attached to a portion of the upper end 28 of the body panel 12. The hood 130 is shaped and adapted to encompass a portion of the individual's or baby's head when the clothing item 12 has been connected or assembled about the baby.

Figure 5:
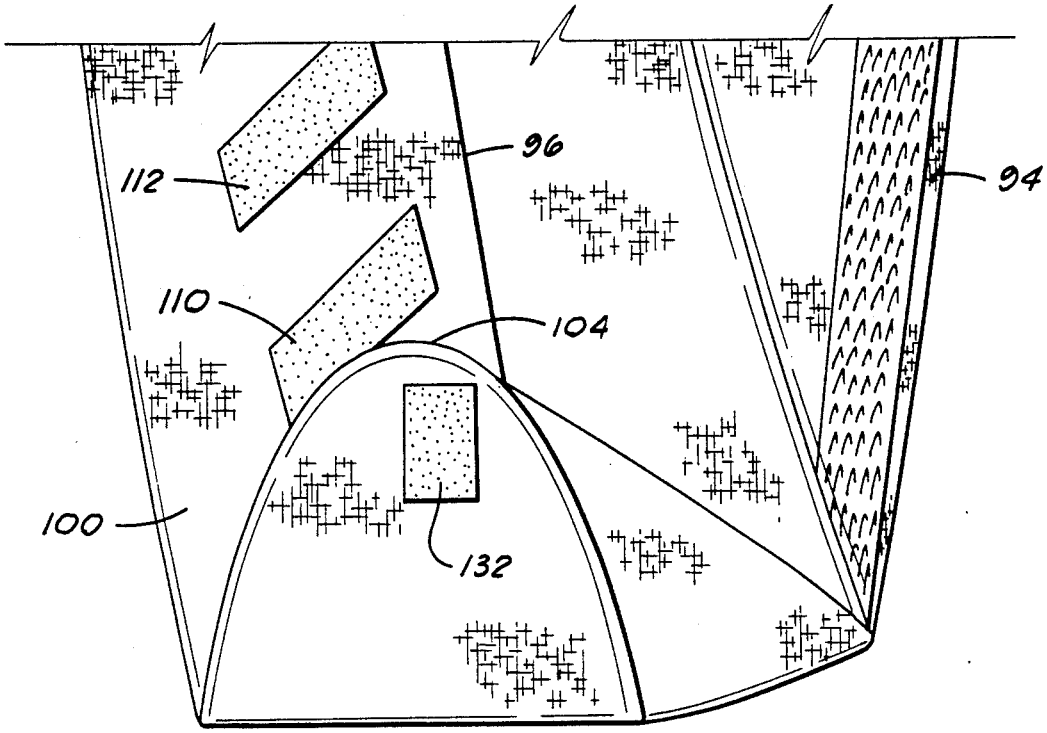
FIG. 5 is a view of a left leg panel showing a lower end portion thereof folded generally upwardly and adjacent a portion of the leg panel for shortening the leg panel.
Figure 6:
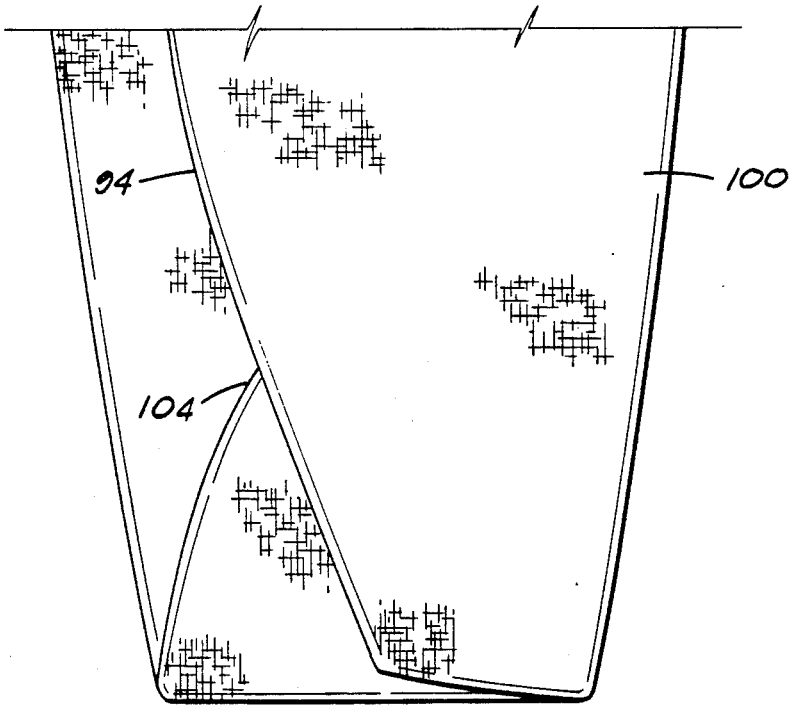
FIG. 6 is a view similar to FIG. 5, but showing the left side portion of the leg panel folded over and attached to the folded portion of the leg panel for closing the leg panel.

In one preferred embodiment and as shown in FIG. 5, the left leg panel 18 also includes a Velcro strip 132 connected to the outer surface 100 of the left leg panel 18 generally adjacent the lower end 104 of the left leg panel 18. In the opened position as shown in FIGS. 2 and 5, a portion of the left leg panel 18 generally near the lower end 104 thereof can be folded generally upwardly to a position wherein some of the Velcro strips 108, 110, 112, 114 and 115 are disposed generally adjacent some of the other Velcro strips 108, 110, 112, 114 and 115. The left side 94 portion of the left leg panel 18 then is folded over and affixed to the right side portion 96 of the left leg panel 18 in the manner described before with a portion of the Velcro® strip 58 being connected to the Velcro® strip 132, as shown in FIG. 6. Thus, as just described, the overall length of the left leg space 116 can be adjustably varied.

In a preferred form, the right leg panel 16 also includes the additional Velcro strip like the Velcro strip 132 so that the overall length of the right leg space 92 can be adjustably varied in the same manner as just described above with respect to the right leg space 92.

Figure 7:
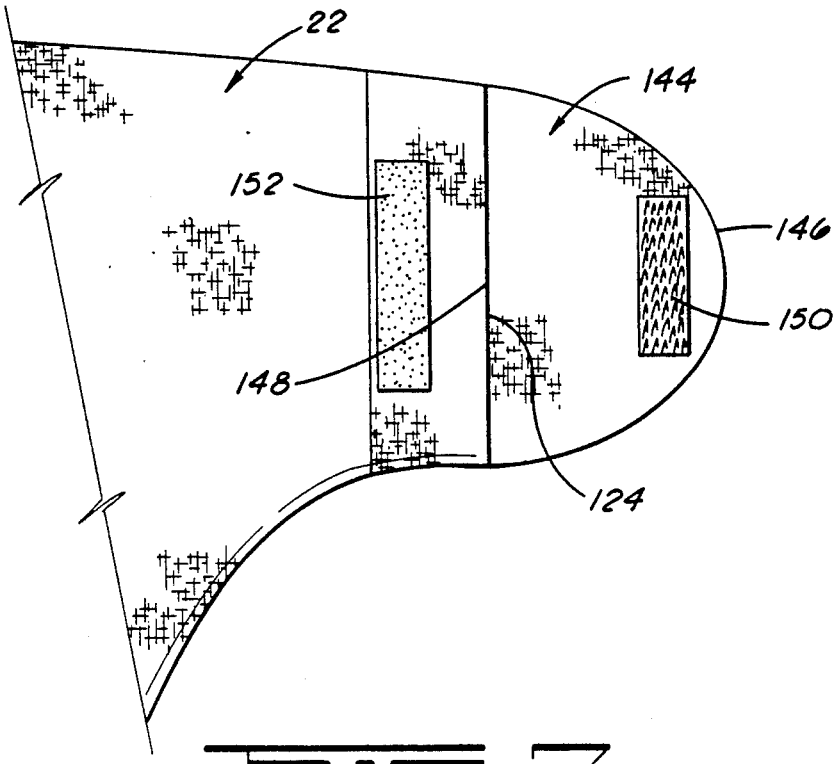
FIG. 7 is a view of a modified left sleeve having a sleeve flap connected thereto, the sleeve flap being shown in the opened position.
Figure 8:
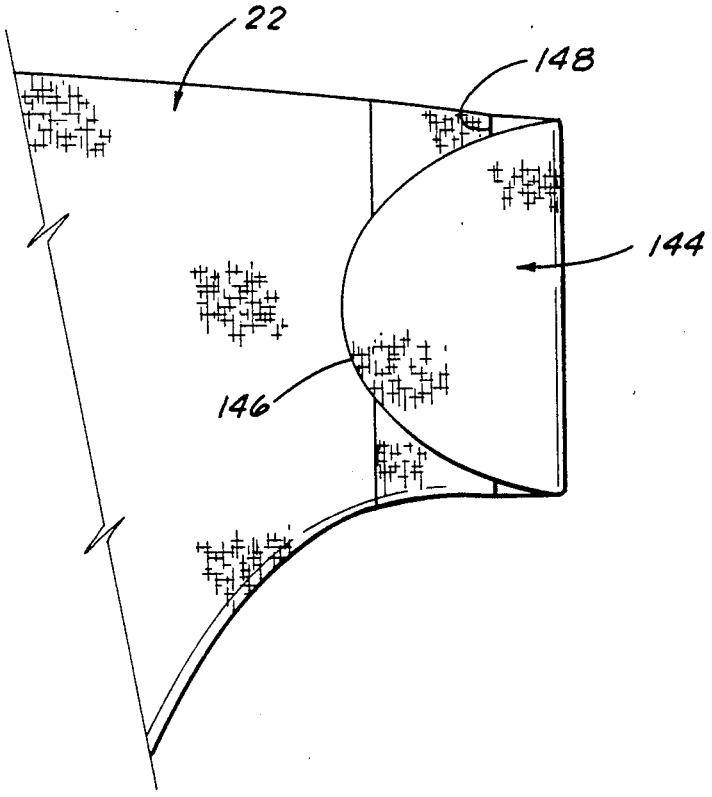
FIG. 8 is a view similar to FIG. 7, but showing the sleeve flap in the closed position.

As shown in FIGS. 7 and 8 and in one embodiment, the clothing item 10 also includes a left sleeve flap 144 having a first end 146 and a second end 148. The second end 148 of the left sleeve flap 144 is connected to the first end 124 of the left sleeve 22. The left sleeve flap 144 is foldable generally over the first end 124 portion of the left sleeve 22 for closing the left arm opening 128 and the left sleeve 22 generally at the first end 124 of the left sleeve 22. The left sleeve flap 144 is connected to the left sleeve 22 in this folded over or closed position by Velcro strips 150 and 152 on the left sleeve flap 144 and the left sleeve 22, respectively.

In a preferred form, the clothing item 10 also includes a right sleeve flap connected to the right sleeve 20 which is foldable to a closed position for closing the right arm opening 122 in the manner just described before with respect to the left sleeve flap 144.

The right side 32 of the body panel 12 is adjustably and removably connected to the lower end panel 14 and the left side 34 of the body panel 12 is adjustably and removably connected to the lower end panel 14 so that a space encompassed by the body panel 12 and the lower end panel 14 can be adjustably increased and decreased to accommodate different sizes of individuals or to accommodate growth of an individual.

It should be noted that in some instances the Velcro strips described herein can be eliminated as attachment means for attaching various portions of the clothing item 10. In particular, certain materials tend to attach to themselves in such a manner that Velcro strips are not necessary. For example, a certain flannel manufactured by Guilford/Rosewood Mills, Style 11796 flannel will attach itself in the manner just described.

The clothing item 10 of the present invention provides an over or outer coat for a baby, pajamas or an over sleeper (an overcoat to go over the baby's pajamas to keep the baby warm in lieu of a blanket which a baby might crawl out from under). The clothing item 10 also could be used as a car seat blanket for a baby. The clothing item 10 particularly is constructed and adapted so that it easily can be bundled about a baby in a blanket form, but at the same time keeping the baby's legs separate which is particularly useful when the baby is to be seated in the car seat.

The lower end panel 14 also can be folded at a position generally between the upper and lower ends 40 and 42 and wrapped about the baby thereby effectively lengthening the body panel 12.

It should be noted that, in lieu of the Velcro strips 82, 84, 86, 88 and 90 and in lieu of the Velcro strips 108, 110, 112, 114 and 115, single Velcro strips extending generally between the upper and lower ends of the right and left leg panels 16 and 18 could be utilized. Also, in lieu of the Velcro strips 48 and 50, a single Velcro strip extending generally between the upper and lower end of the lower end panel 14 could be utilized.

Also, in lieu of Velcro strips 54 and 56 several Velcro strips could be used in a horizontal position, which would allow greater size adjustability of the upper body panel.

Changes may be made in the construction of the various elements and assemblies described herein without departing from the spirit and scope of the invention as defined in the following claims.

What is claimed is:

1. A clothing item adapted to be worn by an individual comprising:

a body panel having an inner surface, an outer surface, a lower end and an upper end, a left side and a right side adapted to be wrapped generally about a substantial portion of the individual's torso;

a lower end panel having an inner surface, an outer surface, a left side and a right side; an upper end and a lower end, the lower end panel having an opened position wherein the lower end panel extends a distance from the body panel and a closed position wherein the lower end panel is folded over a portion of the body panel to a position wherein the inner surface of the lower end panel is disposed generally adjacent a portion of the inner surface of the body panel, the individual's torso being disposable on the inner surface of the body panel and the lower end panel being moveable generally toward the closed position to a position wherein the inner surface of the lower end panel is disposed generally adjacent a portion of the individual's torso and a portion of the body panel generally near the right side thereof being moveable over a portion of the individual's torso to a position wherein a portion of the inner surface of the body panel generally near the right side of the body panel is disposed generally over a portion of the outer surface of the lower end panel, and a portion of the body panel generally near the left side thereof being moveable over a portion of the individual's torso to a position wherein a portion of the inner surface of the body panel generally near the left side of the body panel is disposed generally over a portion of the outer surface of the lower end panel with the body panel covering a substantial portion of the lower end panel;

means for removably and adjustably connecting a portion of the left side of the body panel to a portion of the right side of the body panel or removably and adjustably connecting a portion of the body panel generally near the right side thereof to a portion of the lower end panel and removably and adjustably connecting a portion of the body panel generally near the left side thereof to a portion of the lower end panel whereby a size of a space encompassed by the body panel and the lower end panel is adjustably increasable or decreasable;

a right leg panel having a right side, a left side, an inner surface, an outer surface, an upper end and a lower end, a portion of the right leg panel generally at the right side of the right leg panel and extending a distance therefrom being connected to a portion of the lower end of the body panel generally at the right side thereof and extending a distance therefrom, and a portion of the right leg panel generally at the left side thereof and extending a distance therefrom being connected to a portion of the lower end of the lower end panel, the left side and the right side of the right leg panel being foldable to a position wherein the right side is disposed generally near the left side whereby a right leg space is formed which is shaped and adapted to receive the right leg of the individual;

means for removably and adjustably connecting the left side of the right leg panel to the right side of the right leg panel whereby the size of the right leg space is increasable and decreasable;

a left leg panel having a right side, a left side, an inner surface, a outer surface, an upper end and a lower end, a portion of the left leg panel generally at the left side of the left leg panel and extending a distance therefrom being connected to a portion of the lower end of the body panel generally at the left side thereof and extending a distance therefrom, and a portion of the left leg panel generally at the right side thereof and extending a distance therefrom being connected to a portion of the lower end of the lower end panel, the left side and the right side of the left leg panel being foldable to a position wherein the right side is disposed generally near the left side whereby a left leg space is formed which is shaped and adapted to receive the left leg of the individual, the lower end panel being connected to the body panel by way of the right leg panel and the left leg panel at a position generally midway between the left side and the right side of the body panel; and means for removably and adjustably connecting the left side of the left leg panel to the right side of the left leg panel whereby the size of the left leg space is increasable and decreasable.

2. The clothing item of claim 1 wherein the body panel is defined further to comprise a left arm opening formed through the body panel generally near the upper end thereof shaped and adapted for receiving an individual's left arm which is extendable through the left arm opening, and a right arm opening formed through the body panel generally near the upper end thereof shaped and adapted for receiving an individual's right arm which is extendable through the right arm opening.

3. The clothing item of claim 1 wherein the means for adjustably connecting the left side to the right side of the right leg panel is defined further as comprising:

a plurality of attaching means, each attaching means being connected to the outer surface of the right leg panel and each attaching means being disposed generally near the left side of the right leg panel and extending a distance generally toward the right side of the right leg panel, the attaching means being spaced apart and being disposed generally along the left side and generally between the upper end and the lower end of the right leg panel; and means attached to the inner surface of the right leg panel and extending generally between the upper end and the lower end of the right leg panel generally near the right side of the right leg panel, said means being removably attachable to said attaching means.

4. The clothing item of claim 3 wherein the means for adjustably connecting the left side to the right side of the left leg panel is defined further as comprising:

a plurality of attaching means, each attaching means being connected to the outer surface of the left leg panel and each attaching means being disposed generally near the right side of the left leg panel and extending a distance generally toward the left side of the left leg panel, the attaching means being spaced apart generally along the right side of the left leg panel and generally between the upper and the lower ends of the left leg panel; and means attached to the inner surface of the left leg panel and extending a distance generally between the upper end and the lower end of the left leg panel generally near the left side of the left leg panel, said means being removably attachable to said attaching means.

5. The clothing item of claim 2 defined further to comprise:

a right sleeve having a first end and a second end and a right arm opening extending therethrough intersecting the first and second ends thereof, the second end of the right sleeve being connected to the body panel and positioned so the right arm opening in the body panel is aligned with the right arm opening in the right sleeve.

6. The clothing item of claim 5 defined further to comprise:

a right sleeve flap connected to the first end of the right sleeve, the right sleeve flap being foldable generally over the first end of the right sleeve for closing the right arm opening in the right sleeve generally at the first end of the right sleeve; and means for removably connecting the right sleeve flap to a portion of the right sleeve when the right sleeve is folded over the first end of the right sleeve.

7. The clothing item of claim 5 defined further to comprise:

a left sleeve having a first end and a second end and a left arm opening extending therethrough intersecting the first and the second ends thereof, the second end of the left sleeve being connected to the body panel and positioned so that the left arm opening in the body panel is aligned with the left arm opening in the left sleeve.

8. The clothing item of claim 7 defined further to comprise:

a left sleeve flap connected to the first end of the left sleeve, the left sleeve flap being foldable over the first end of the left sleeve for closing the left arm opening in the left sleeve generally at the first end of the left sleeve; and means for removably connecting the left sleeve flap to a portion of the left sleeve when the left sleeve is folded over the first end of the left sleeve.

9. A clothing item adapted to be worn by an individual comprising:

a body panel having an inner surface, an outer surface, a lower end and an upper end, a left side and a right side adapted to be wrapped generally about a substantial portion of the individual's torso;

a lower end panel having an inner surface, an outer surface, a left side and a right side; an upper end and a lower end, the lower end panel having an opened position wherein the lower end panel extends a distance from the body panel and a closed position wherein the lower end panel is folded over a portion of the body panel to a position wherein the inner surface of the lower end panel is disposed generally adjacent a portion of the inner surface of the body panel, the individual's torso being disposable on the inner surface of the body panel and the lower end panel being moveable generally toward the closed position to a position wherein the inner surface of the lower end panel is disposed generally adjacent a portion of the individual's torso and a portion of the body panel generally near the right side thereof being moveable over a portion of the individual's torso to a position wherein a portion of the inner surface of the body panel generally near the right side of the body panel is disposed generally over a portion of the outer surface of the lower end panel, and a portion of the body panel generally near the left side thereof being moveable over a portion of the individual's torso to a position wherein a portion of the inner surface of the body panel generally near the left side of the body panel is disposed generally over a portion of the outer surface of the lower end panel;

means for removably connecting a portion of the left side of the body panel to a portion of the right side of the body panel or removably connecting a portion of the body panel generally near the right side thereof to a portion of the lower end panel and removably connecting a portion of the body panel generally near the left side thereof to a portion of the lower end panel;

a right leg panel having a right side, a left side, an inner surface, an outer surface, an upper end and a lower end, a portion o the right leg panel generally at the right side of the right leg panel and extending a distance therefrom being connected to a portion of the lower end of the body panel generally at the right side thereof and extending a distance therefrom, and a portion of the right leg panel generally at the left side thereof and extending a distance therefrom being connected to a portion of the lower end of the lower end panel, the left side and the right side of the right leg panel being foldable to a position wherein the right side is disposed generally near the left side whereby a right leg space is formed which is shaped and adapted to receive the right leg of the individual, the right leg panel being foldable at a position generally between the upper end and the lower end of the right leg panel to a position wherein a portion of the right leg panel near the lower end thereof, a folded portion, is disposed generally over a portion of an unfolded portion of the right leg panel;

a left leg panel having a right side, a left side, an inner surface, a outer surface, an upper end and a lower end, a portion of the left leg panel generally at the left side of the left leg panel and extending a distance therefrom being connected to a portion of the lower end of the body panel generally at the left side thereof and extending a distance therefrom, and a portion of the left leg panel generally at the right side thereof and extending a distance therefrom being connected to a portion of the lower end of the lower end panel, the left side and the right side of the left leg panel being foldable to a position wherein the right side is disposed generally near the left side whereby a left leg space is formed which is shaped and adapted to receive the left leg of the individual, the lower end panel being connected to the body panel by way of the right leg panel and the left leg panel at a position generally midway between the left side and the right side of the body panel;

means for removably connecting the left side of the left leg panel to the right side of the left leg panel;

means for removably connecting the left side of the right leg panel to the right side of the right leg panel;

means for connecting the folded portion of the right leg panel to the unfolded portion of the right leg panel whereby a length of the right leg panel is adjustably variable.

10. A clothing item adapted to be worn by an individual comprising:

a body panel having an inner surface, an outer surface, a lower end and an upper end, a left side and a right side adapted to be wrapped generally about a substantial portion of the individual's torso;

a lower end panel having an inner surface, an outer surface, a left side and a right side; an upper end and a lower end, the lower end panel having an opened position wherein the lower end panel extends a distance from the body panel and a closed position wherein the lower end panel is folded over a portion of the body panel to a position wherein the inner surface of the lower end panel is disposed generally adjacent a portion of the inner surface of the body panel, the individual's torso being disposable on the inner surface of the body panel and the lower end panel being moveable generally toward the closed position to a position wherein the inner surface of the lower end panel is disposed generally adjacent a portion of the individual's torso and a portion of the body panel generally near the right side thereof being moveable over a portion of the individual's torso to a position wherein a portion of the inner surface of the body panel generally near the right side of the body panel is disposed generally over a portion of the outer surface of the lower end panel, and a portion of the body panel generally near the left side thereof being moveable over a portion of the individual's torso to a position wherein a portion of the inner surface of the body panel generally near the left side of the body panel is disposed generally over a portion of the outer surface of the lower end panel;

means for removably connecting a portion of the left side of the body panel to a portion of the right side of the body panel or removably connecting a portion of the body panel generally near the right side thereof to a portion of the lower end panel and removably connecting a portion of the body panel generally near the left side thereof to a portion of the lower end panel;

a right leg panel having a right side, a left side, an inner surface, an outer surface, an upper end and a lower end, a portion of the right leg panel generally at the right side of the right leg panel and extending a distance therefrom being connected to a portion of the lower end of the body panel generally at the right side thereof and extending a distance therefrom, and a portion of the right leg panel generally at the left side thereof and extending a distance therefrom being connected to a portion of the lower end of the lower end panel, the left side and the right side of the right leg panel being foldable to a position wherein the right side is disposed generally near the left side whereby a right leg space is formed which is shaped and adapted to receive the right leg of the individual;

a left leg panel having a right side, a left side, an inner surface, a outer surface, an upper end and a lower end, a portion of the left leg panel generally at the left side of the left leg panel and extending a distance therefrom being connected to a portion of the lower end of the body panel generally at the left side thereof and extending a distance therefrom, and a portion of the left leg panel generally at the right side thereof and extending a distance therefrom being connected to a portion of the lower end of the lower end panel, the left side and the right side of the left leg panel being foldable to a position wherein the right side is disposed generally near the left side whereby a left leg space is formed which is shaped and adapted to receive the left leg of the individual, the lower end panel being connected to the body panel by way of the right leg panel and the left leg panel at a position generally midway between the left side and the right side of the body panel, the left leg panel being foldable at a position generally between the upper end and the lower end of the left leg panel to a position wherein a portion of the left leg panel near the lower end thereof, a folded portion, is disposed generally over a portion of an unfolded portion of the left leg panel;

means for removably connecting the left side of the right leg panel to the right side of the right leg panel;

means for connecting the folded portion of the left leg panel to the unfolded portion of the left leg panel whereby a length of the left leg panel is adjustably variable.

* * * * *